United States Patent [19]

Ito et al.

[11] Patent Number: 5,046,937

[45] Date of Patent: Sep. 10, 1991

[54] SLIP-CASTING MOLDS

[75] Inventors: Takeshi Ito, Nagoya; Kazushige Murata, Tokoname; Kuniyoshi Kohmura, Nagoya, all of Japan

[73] Assignee: Inax Corporation, Japan

[21] Appl. No.: 381,050

[22] Filed: Jul. 17, 1989

[30] Foreign Application Priority Data

Jul. 19, 1988 [JP] Japan ..... 63-95503[U]

[51] Int. Cl.[5] ..... B28B 1/26

[52] U.S. Cl. ..... 425/85; 249/113; 249/141; 264/87; 264/302; 425/812

[58] Field of Search ..... 425/84, 85, 812; 264/302, 304, 86, 87; 249/113, 141

[56] References Cited

U.S. PATENT DOCUMENTS

| | | | |
|---|---|---|---|
| 3,156,751 | 11/1964 | Valdes et al. | 264/87 |
| 3,286,974 | 11/1966 | Dean et al. | 249/141 |
| 3,659,994 | 5/1972 | Ehrlich | 264/87 |
| 3,993,727 | 11/1976 | Skriletz et al. | 264/87 |
| 4,528,152 | 7/1985 | Aoyama et al. | 264/87 |
| 4,591,472 | 5/1986 | Gerster | 264/87 |
| 4,818,457 | 4/1989 | Ito et al. | 249/141 |
| 4,867,662 | 9/1989 | Shimahara et al. | 425/84 |
| 4,884,959 | 12/1989 | Ito et al. | 425/84 |

FOREIGN PATENT DOCUMENTS

| | | | |
|---|---|---|---|
| 211653 | 2/1987 | European Pat. Off. | 264/87 |

*Primary Examiner*—James C. Housel

*Attorney, Agent, or Firm*—Lerner, David, Littenberg, Krumholz & Mentlik

[57] ABSTRACT

A divisible slip-casting mold has filter layers which incorporate a combination of different types of fluid-flow conduits to achieve improved fluid-flow properties. The conduits include major portions of porous ropes arranged in curved lines and minor portions of blind holes installed in straight lines. The porous ropes are essentially installed in those portions of the filter layer where the ropes are readily or uniformly arranged, and the blind holes are essentially installed in those portions of the filter layer which exhibit poor fluid-flow properties and in which installation of porous ropes is difficult. Thus, substantially uniform fluid-flow properties are provided in the filter layers of the mold to enhance mold casting performance.

15 Claims, 2 Drawing Sheets

SLIP-CASTING MOLDS

FIELD OF THE INVENTION

The present invention relates to a slip-casting mold and a method for producing the mold. More particularly, the present invention relates to improvements in a casting mold for molding green articles of sanitaryware, ceramic artware and the like.

BACKGROUND OF THE INVENTION

It is well-known in the art to install fluid-flow conduits consisting of either porous ropes or blind holes, each by themselves, in the filter layers of a slip-casting mold. Even with these conduits, such filter layers have exhibited problems including non-uniform fluid-flow properties. Heretofore, such problems have been considered unavoidable in the art. These problems and the improvements in casting molds in accordance with the present invention are explained in detail in the comparative example and working examples set forth in the present specification.

SUMMARY OF THE INVENTION

The present inventors have attempted to employ fluid-flow conduits consisting of an effective combination of both porous ropes and blind holes, and have unexpectedly found that the conventional problems can be eliminated by installing a specific combination of the porous rope and blind holes in the filter layers of the mold.

Thus, in accordance with the present invention there is provided a mold for casting a slip into a desired shape which comprises a plurality of mold parts assembled together to define an enclosed mold cavity having a shape corresponding to the desired shape, each of the plurality of mold parts including a porous body forming a filter layer for removing water from a volume of the slip in the mold cavity, a plurality of fluid-flow conduits disposed in the filter layer, and a housing member for retaining the porous body, the filter layer having a filter surface in communication with the mold cavity, the filter surface having a predetermined shape including accessible portions and inaccessible portions, and the housing members defining a housing for the mold upon assembly of the plurality of mold parts; a fluid-flow duct for connecting the plurality of fluid-flow conduits with the exterior of the housing; and a slip supply duct communicating between a source of the slip and the mold cavity; the plurality of fluid-flow conduits including a combination of porous ropes arranged in the accessible portions of the filter surface and blind holes extending from the housing into the inaccessible portions of the filter surface, wherein the combination of porous ropes and blind holes provides the filter layer with substantially uniform fluid-flow properties.

The aforementioned divisible casting mold can be produced by the following method which includes the steps of: providing a model for forming a mold cavity having a desired shape; assembling a reinforcing cage about the model; attaching a plurality of porous ropes to the reinforcing cage to form a cage assembly; assembling a plurality of housing members around the cage assembly to form a housing having a void between the housing and the model; filling the void with porous material and solidifying the porous material to form a filter layer; and forming blind holes in the filter layer from the housing towards the mold cavity.

A mold having supporting layers disposed between the housing and the filter layers can similarly be produced from a divided housing by including the supporting layers inside of the divided housing when assembling same over the wire cage.

DETAILED DESCRIPTION OF THE PREFERRED EMBODIMENTS

In view of the relatively high cost of the materials used to form filter layers, and in order to reinforce such filter layers to prevent the deformation thereof, the slip casting mold of the present invention may preferably be formed with a supporting layer disposed between the filter layers and the housing. In other words, the mold comprises supporting layers installed between the air-tight housing for the mold and the filter layers.

The materials for forming the filter layers can be any material which can form a continuously porous solid layer, including porous synthetic resins and gypsum. In order to maximize the performance and durability of the mold, it is generally preferred that the filter layers comprise a continuously porous synthetic resin. In contrast, the supporting layer may be formed from a substantially non-porous solid material.

According to a typical embodiment, there is provided a mold in which blind holes are installed towards the convex portions of the filter layers and extend near the exposed surfaces thereof.

According to another typical embodiment, there is provided a mold in which the blind holes are installed along convex side edge portions of the filter layers, extending near the convex corner portions of the filter layers of the mold.

The porous ropes installed in the molds may include, for example, fibrous cords and fibrous tubes, fibrous tubes (e.g., knitted cotton tubes) normally being employed. The outer diameter of the porous ropes is generally in the range between about 2 mm to about 20 mm. The porous ropes are generally arranged along the filter layers at an interval of about 5 to 60 mm and at a depth of about 10 to 40 mm from the exposed surfaces of the filter layers.

The term "blind hole" as used herein refers to a long narrow hole installed towards the surfaces of the filter layers, the top of which reaches near the filter surfaces at a distance of about 10 mm to about 40 mm therefrom. The diameter of the blind hole is generally in the range of about 5 mm to about 30 mm.

EXAMPLE I (Comparative)

Figure 4:
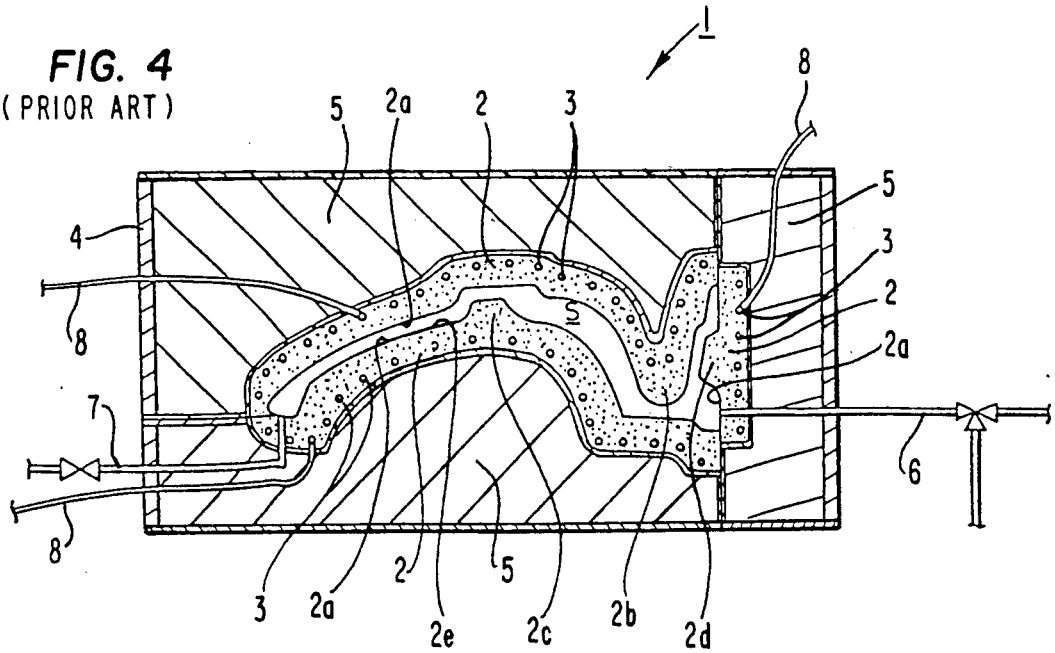
FIG. 4 (PRIOR ART)
FIG. 4 is a vertical cross-sectional view of the prior art mold of comparative Example I.

For comparison, a conventional casting mold 1 is shown in FIG. 4. As is clear from the drawing in FIG. 4, a conventional casting mold includes porous ropes 3 arranged in the filter layers, but does not include any blind holes disposed therein.

Figure 1:
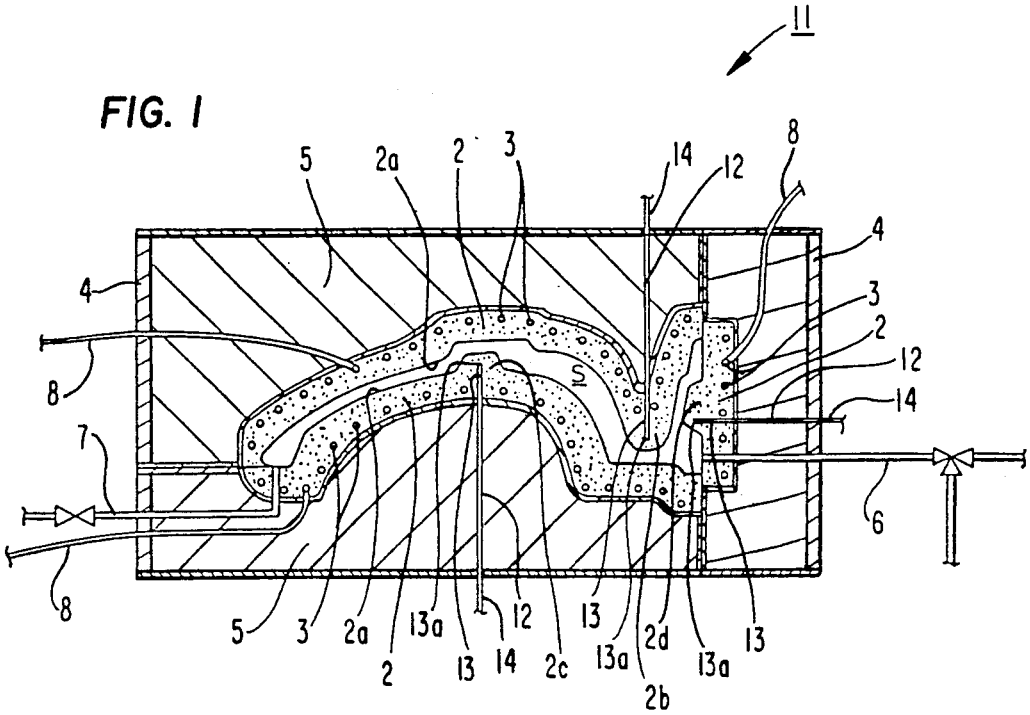
FIG. 1 is a vertical cross-sectional view of the mold of Example II.

This prior art mold 1 consists of divisible filter layers 2, formed from porous solid materials, which form mold cavity S when mated together; fluid-flow conduits 3, 3 arranged along the filter surfaces at a suitable interval inside of the filter layer; housing 4 located outside of the filter layers 2; and supporting layers 5, formed from non-porous solid materials, placed between the filter layers 2 and the housing 4. The fluid-flow conduits 3, 3 in the form of porous tubes are collected and connected with outside ducts 8. The mold cavity S is connected with a slip supply duct 6 and a compressed air duct 7. The layer between the filter layer and supporting layer, as shown in FIGS. 4 and 1, can be an adhesive layer or a layer extending from the housing for reinforcement. Such a layer, however, is not generally needed.

The use of the mold 1 of FIG. 4 for casting a slip is carried out in the following procedure. The mold cavity S is filled with slip supplied via the slip supply duct 6. The slip in the mold cavity is pressurized by means of the slip supply duct 6, while the fluid-flow conduits are depressurized. Thus, the slip is deposited on the inner surfaces *2a* of the filter layers 2, while water contained in the slip is driven out through the filter layers 2 and fluid-flow conduits 3, 3. When the deposited layer reaches a predetermined thickness, the slip supply duct 6 is set to a gravitationally low position and the slip remaining in the mold cavity is drained therefrom via the slip supply duct 6. Compressed air is then introduced into the mold cavity through the compressed air duct 7 to drive out water remaining in the deposited layer via the filter layers 2 and fluid-flow conducts 3, 3. The fluid-flow conduits 3, 3 are subsequently pressurized with air to exude water remaining in the filter layers 2 and conduits 3, 3 onto the interfaces between the filter surfaces *2a* and the deposited layer, and the filter layers 2 are divided to demold the resulting molded article.

As described above, the fluid-flow conduits 3, 3 play an important role both in depositing the slip and demolding the molded article. Therefore, it is preferable that the fluid-flow conduits be uniformly spaced from the filter *2a* so that the slip is deposited uniformly and any water is exuded uniformly onto the filter surfaces *2a*.

It is sometimes technically difficult however, to make the distance between the fluid-flow ropes 3, 3 and the filter surfaces *2a* substantially uniform in portions of the filter layers 2. Such difficult portions of the filter layers include convex portions *2b*, *2c* and *2d* where the filter surfaces protrude from the inner surfaces *2a* of the filter layers 2, because the porous ropes 3 cannot be successfully arranged in such convex (e.g., protruded) portions. Thus, the ability of these convex portions *2b*, *2c* and *2d* to drain water upon the deposition of the casting slip and exude water upon demolding the molded article are considerably inferior than they are in the substantially flat (e.g., non-convex) portions *2e* of the filter layers 2. For that reason, such conventional molds 1 have caused considerable problems in the cast-molding operation.

EXAMPLE II

The most notable improvement in mold 11 of the present invention in comparison with the 1 of comparative Example I includes, as shown in FIG. 1, the incorporation of fluid-flow blind holes 13, the top blind portions 13*a* of which reach in close proximity to the filter surfaces of the convex portions *2b*, *2c*, and *2d*. Incidentally, the blind holes 13 are connected to holes 12 which penetrate the supporting layers 5 in a substantially straight line, and which are generally produced by drilling or the like. The remaining structure of the mold 11 is similar to that discussed above in connection with comparative Example I, shown in FIG. 4, the same reference numerals identifying the same elements.

After the supporting layers 5 and filter layers 2 are formed, the blind holes 13 and the holes 12 penetrating the supporting layers 5 are produced by successively drilling through the supporting layers 5 towards the filter surfaces *2a* in the convex portions of the filter layers. By connecting the penetrating holes 12 with outer ducts 14, the blind holes 13 can be depressurized or pressurized as desired. The areas having non-uniform fluid-flow properties, such as convex portions *2b*, *2c* and *2d*, as well as the positions, diameters and numbers of blind holes 13 to be installed therein can be empirically determined. It is known in the art that such non-uniform areas can be determined by flowing water through fluid-flow conduits, such as porous ropes, and observing how wet different areas of the filter surface gets, or by conducting slip-casting operations and observing the surfaces of the molded articles or the filter layers. In addition, the diameter of the blind holes 13 can be enlarged and the number of such holes increased to an optimum level according to the results achieved in the casting operation. Moreover, the distance (i.e., depth) between the end portions 13*a* of the blind holes and the filter surfaces *2a* can be optimized according to the results obtained in the casting operation. Incidentally, the blind holes 13 can contain some fillers such as fibers in order to store sufficient water therein to exude water upon demolding the molded article.

EXAMPLE III

Figure 2:
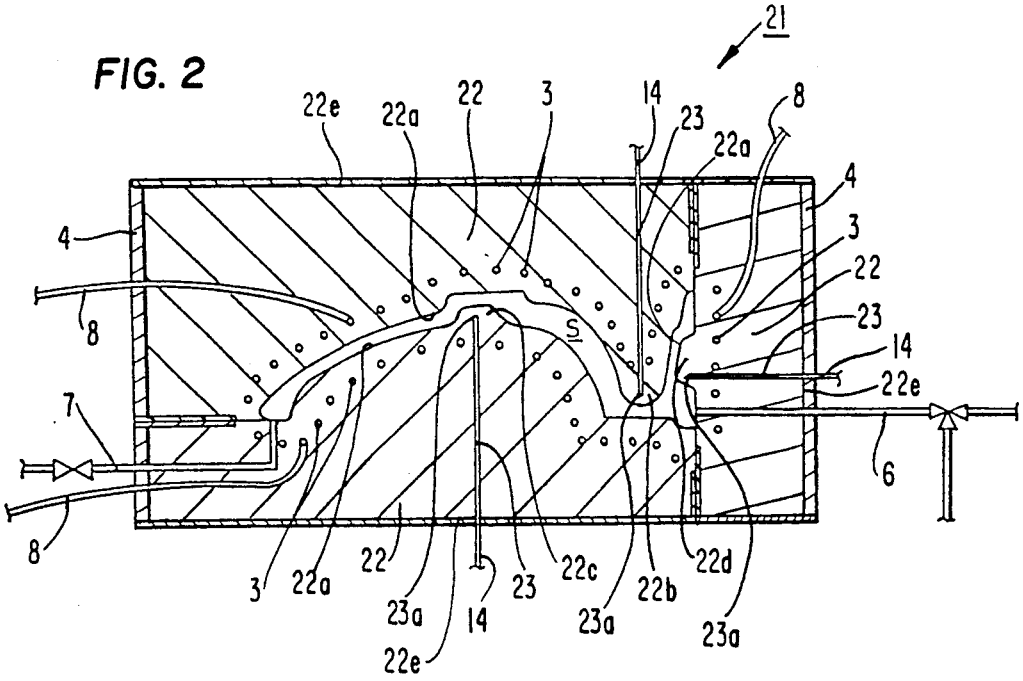
FIG. 2 is a vertical cross-sectional view of the mold of Example III.

The vertical cross-section of another mold 21 of the present invention is shown in FIG. 2. In comparison with the mold 11 discussed above, the filter layers 22 of mold 21 are directly supported by the housing 4 without supporting layers interposed therebetween. Fluid-flow blind holes 23 are installed so that they extend from outer surfaces 22*e* of the filter layers 22 to the end portions 23*a*, positioned in close proximity to the filter surfaces of convex portions 22*b*, 22*c* and 22*d*. After the filter layers are produced, the blind holes 23 can be formed by drilling or the like from the outer surfaces 22*e* towards the filter surfaces 22*a*. The blind holes 23 are connected with outer ducts 14 which enable the blind holes to be depressurized or pressurized as desired.

EXAMPLE IV

Figure 3:
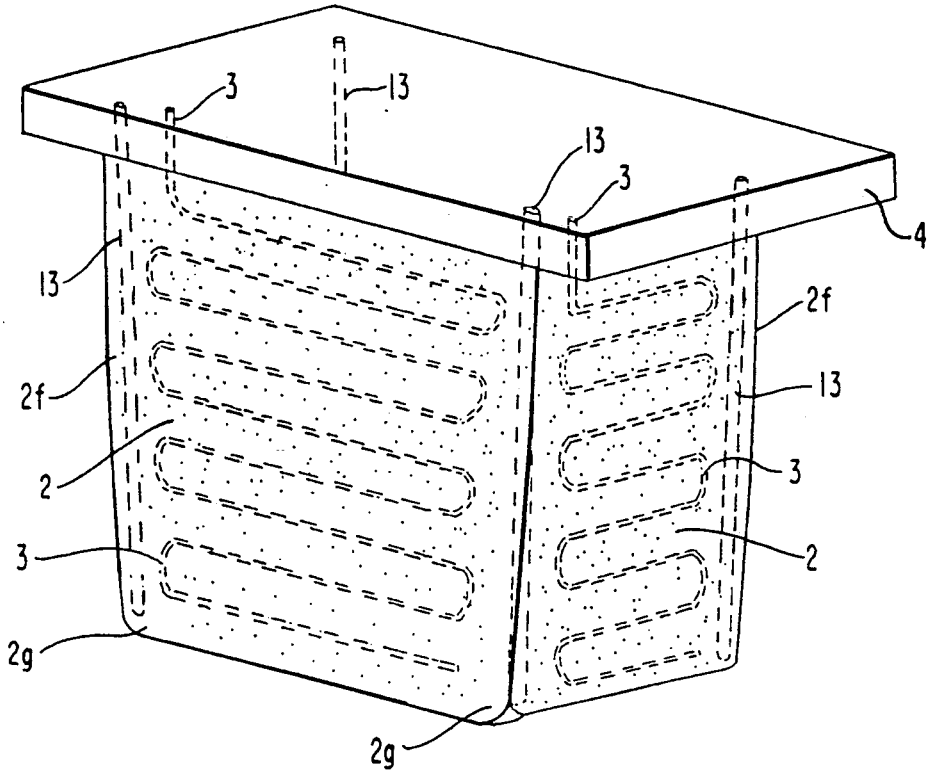
FIG. 3 is a perspective view of the mold of Example IV.

FIG. 3 is a perspective view showing an upper mold portion of a divisible two-portion mold for producing a rectangular parallelepiped vessel, the same reference numerals identifying the same elements as in FIG. 1. The mold comprises filter layers 2 containing both porous tubes 3 and blind holes 13, and exhibits uniform fluid-flow properties.

More specifically, in accordance with traditional mold-forming techniques, uniform fluid-flow properties cannot be obtained in the convex side edge portions *2f* formed by adjoining side filter surfaces, and especially the convex corner portions *2g* of the filter layers 2, because it is difficult to arrange the porous tubes 3 near the edge portions and corner portions of the filter layers. Similarly, it is impossible or at least not practical to install a lot of deep blind holes along the side filter layers and bottom layers in place of the porous tubes 3 because it is very difficult to drill a number of blind holes about 30 cm deep or sufficient to provide uniform fluid-flow properties to the filter layer.

In accordance with the present invention, porous tubes 3 are arranged along the relatively side and bottom filter layers of the mold, and four blind holes 13 are installed along the four convex edge portions of the filter layers, thereby successfully eliminating the non-uniform fluid-flow problems associated with such casting molds. In other words, highly effective and improved performances can now be obtained in slip-casting molds in which it has heretofore been difficult to install large numbers of blind holes by combining a minimum number of blind holes with major portions of porous tubes in the filter layers of the mold.

We claim:

1. A mold for casting a slip into a desired shape comprising, a plurality of mold parts assembled together to define an enclosed mold cavity having a shape corresponding to said desired shape, each of said plurality of mold parts including a porous body forming a filter layer for removing water from a volume of said slip in said mold cavity, a plurality of fluid-flow conduits disposed in said filter layer, and a housing member for retaining said porous body, said filter layer having a filter surface in communication with said mold cavity, the filter surface of at least one of said mold parts having a predetermined shape including protruding portions and said housing members defining a housing for said mold upon assembly of said plurality of mold parts, a fluid-flow duct for connecting said plurality of fluid-flow conduits with the exterior of said housing, a slip supply duct communicating between a source of said slip and said mold cavity, said plurality of fluid-flow conduits including a combination of porous ropes arranged in said filter layer and blind holes extending from said housing into said filter layer to within said protruding portions, wherein said combination of porous ropes and blind holes provides said filter layer with substantially uniform fluid-flow properties.

2. A mold as claimed in claim 1 wherein said filter surface includes concave portions and substantially flat portions and said protruding portions include convex portions of said filter surface.

3. A mold as claimed in claim 1 wherein said porous ropes are arranged in curved patterns in said filter layer and said blind holes extend in substantially straight lines from said housing into said protruding portions of said filter surface.

4. A mold as claimed in claim 1 wherein said filter layer is formed from a porous synthetic resin.

5. A mold as claimed in claim 1 wherein said blind holes extend from an open end at said housing to a closed end a predetermined distance from said filter surface, said predetermined distance being between about 10 mm and about 40 mm.

6. A mold as claimed in claim 1 wherein said protruding portions of said filter surface include surface portions joining to form substantially straight convex edge portions and said blind holes extend along said convex edge portions.

7. A mold as claimed in claim 1 further comprising a filler material disposed in said blind holes for storing water in said blind holes.

8. A mold as claimed in claim 1 wherein each of said plurality of mold parts further includes a supporting layer disposed between said filter layer and said housing.

9. A mold as claimed in claim 8 wherein said supporting layer is substantially non-porous.

10. A mold as claimed in claim 8 wherein said porous ropes are arranged in curved patterns in said filter layer and said blind holes extend in substantially straight lines from said housing into said protruding portions of said filter surface.

11. A mold as claimed in claim 8 wherein said filter layer in formed from a porous synthetic resin.

12. A mold as claimed in claim 8 wherein said blind holes extend from an open end at said housing to a closed end a predetermined distance from said filter surface, said predetermined distance being between about 10 mm and about 40 mm.

13. A mold as claimed in claim 8 wherein said protruding portions of said filter surface include surface portions joining to form substantially straight convex edge portions and said blind holes extend along said convex edge portions.

14. A mold as claimed in claim 8 further comprising a filler material disposed in said blind holes for storing water in said blind holes.

15. A mold as claimed in claim 8 wherein said filter surface includes concave portions and substantially flat portions, and said protruding portions include convex portions of said filter surface.

* * * * *

UNITED STATES PATENT AND TRADEMARK OFFICE

CERTIFICATE OF CORRECTION

PATENT NO. : 5,046,937

DATED : September 10, 1991

INVENTOR(S) : Ito et al.

It is certified that error appears in the above-identified patent and that said Letters Patent is hereby corrected as shown below:

Column 3, line 43, after "any" insert --remaining--.

Column 3, line 47, after "in" insert --certain--.

Column 3, line 55, after "and" insert --to--.

Column 3, line 63, after "the" insert --mold--.

Column 4, line 21, after "wet" insert --the--.

Column 5, line 1, after "bottom" insert --filter--.

Column 5, line 3, after "or" insert --more--.

Column 5, line 6, after "relatively" insert --flat--.

Signed and Sealed this

Ninth Day of March, 1993

*Attest:*

STEPHEN G. KUNIN

*Attesting Officer*

*Acting Commissioner of Patents and Trademarks*